US011170927B2

(12) United States Patent
Yoon et al.

(10) Patent No.: US 11,170,927 B2
(45) Date of Patent: Nov. 9, 2021

(54) COIL COMPONENT

(71) Applicant: SAMSUNG ELECTRO-MECHANICS CO., LTD., Suwon-si (KR)

(72) Inventors: Chan Yoon, Suwon-si (KR); Young Ghyu Ahn, Suwon-si (KR); Dong Hwan Lee, Suwon-si (KR); Dong Jin Lee, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 314 days.

(21) Appl. No.: 16/163,009

(22) Filed: Oct. 17, 2018

(65) Prior Publication Data

US 2019/0362877 A1 Nov. 28, 2019

(30) Foreign Application Priority Data

May 24, 2018 (KR) ..... 10-2018-0058708

(51) Int. Cl.

| | |
|---|---|
| ***H01F 27/28*** | (2006.01) |
| ***H01F 27/02*** | (2006.01) |
| ***H01F 27/24*** | (2006.01) |
| ***H01F 17/00*** | (2006.01) |
| ***H01F 27/29*** | (2006.01) |
| ***H01F 27/32*** | (2006.01) |

(52) U.S. Cl.

CPC ..... *H01F 27/022* (2013.01); *H01F 17/0013* (2013.01); *H01F 27/24* (2013.01); *H01F 27/29* (2013.01); *H01F 27/32* (2013.01)

(58) Field of Classification Search

CPC .... H01F 27/022; H01F 27/24; H01F 17/0013; H01F 27/29; H01F 27/32; H01F 2017/048; H01F 27/292; H01F 17/04; H01F 27/327; H01F 27/306; H01F 2027/2809; H01F 27/2804

See application file for complete search history.

(56) References Cited

U.S. PATENT DOCUMENTS

| | | | | |
|---|---|---|---|---|
| 6,114,938 | A * | 9/2000 | Iida | H01F 17/0006 336/200 |
| 2003/0052767 | A1* | 3/2003 | Yamanobe | H01F 41/04 336/232 |
| 2004/0145442 | A1* | 7/2004 | Matsutani | H01F 27/292 336/200 |

(Continued)

FOREIGN PATENT DOCUMENTS

| | | | |
|---|---|---|---|
| KR | 10-1999-0066108 | A | 8/1999 |
| KR | 10-2010-0069604 | A | 6/2010 |
| KR | 10-2018-0000931 | A | 1/2018 |

*Primary Examiner* — Mang Tin Bik Lian

(74) *Attorney, Agent, or Firm* — Morgan, Lewis & Bockius LLP

(57) ABSTRACT

A coil component includes: a body including a coil and an encapsulant encapsulating the coil; and an external electrode disposed on an external surface of the body, wherein a core center of the coil is filled with the encapsulant, the coil includes a plurality of coil patterns connected to each other by a via, the plurality of coil patterns have a stacked structure in which the plurality of coil patterns are stacked in one direction, and the external electrode includes a first external electrode, a second external electrode, and a third external electrode disposed to be spaced apart from one another.

17 Claims, 13 Drawing Sheets

(56) References Cited

U.S. PATENT DOCUMENTS

| | | | | |
|---|---|---|---|---|
| 2007/0002513 | A1* | 1/2007 | Matsuoka | H03H 7/1708 361/118 |
| 2008/0218301 | A1* | 9/2008 | Yamaguchi | H01F 17/0013 336/83 |
| 2010/0148905 | A1 | 6/2010 | Matsumoto | |
| 2013/0062994 | A1* | 3/2013 | Ogawa | H01G 4/30 310/311 |
| 2013/0234819 | A1* | 9/2013 | Yoo | H01F 17/0013 336/200 |
| 2014/0300441 | A1* | 10/2014 | Jeong | H01F 3/14 336/192 |
| 2016/0042862 | A1* | 2/2016 | Tachibana | H01F 27/2804 336/200 |
| 2016/0104563 | A1* | 4/2016 | Jeong | H01F 27/292 336/192 |
| 2017/0372833 | A1 | 12/2017 | Jang et al. | |

* cited by examiner

COIL COMPONENT

CROSS-REFERENCE TO RELATED APPLICATION(S)

This application claims the benefit of priority to Korean Patent Application No. 10-2018-0058708 filed on May 24, 2018 in the Korean Intellectual Property Office, the disclosure of which is incorporated herein by reference in its entirety.

TECHNICAL FIELD

The present disclosure relates to a coil component, and more particularly, to a multi-terminal power inductor.

BACKGROUND

Recently, demand for power inductors appropriate for high current and having high efficiency, high performance, a small size, and a small thickness has increased. In addition, demand for special power inductors has also increased. Among such power inductors, there is demand for a multi-terminal power inductor in which a plurality of inductances may be simultaneously implemented in a single chip.

SUMMARY

An aspect of the present disclosure may provide a coil component in which a plurality of inductances may be simultaneously implemented in a single chip.

According to an aspect of the present disclosure, a coil component may include: a body including a coil and an encapsulant encapsulating the coil; and an external electrode disposed on an external surface of the body, wherein a core center of the coil is filled with the encapsulant, the coil includes a plurality of coil patterns electrically connected to each other through a via, the plurality of coil patterns each have a stacked structure in which the plurality of coil patterns are stacked in one direction, and the external electrode includes a first external electrode, a second external electrode, and a third external electrode disposed to be spaced apart from one another.

The plurality of coil patterns may include a first coil pattern directly connected to the first external electrode, a second coil pattern directly connected to the second external electrode, and a third coil pattern directly connected to the third external electrode.

At least one of the first to third coil patterns may have a stacked structure in which a plurality of coil patterns are connected to each other through the via.

The at least one of the first to third coil patterns having the stacked structure may include a plurality of sub-coil patterns, and both end portions of at least one of the plurality of sub-coil patterns may be connected to the via.

The body may further include a support member in contact with the plurality of coil patterns.

The support member may include a through-hole, and the through-hole may coincide with the core center of the coil.

The external electrode may further include a dummy electrode that is not directly connected to any of the plurality of coil patterns.

The dummy electrode may be disposed to be symmetrical to one of the first to third external electrodes.

A thin film layer including a via may be disposed between coil patterns adjacent to each other.

The thin film layer may be an insulating film.

A thickness of the thin film layer may be smaller than that of the support member.

At least one coil pattern among the plurality of coil patterns may include at least one line width change portion in which a line width of the at least one coil pattern changes in a winding direction.

The body may have first and second end surfaces opposing each other in a length direction, first and second side surfaces opposing each other in a width direction, and upper and lower surfaces opposing each other in a thickness direction.

The one direction in which the plurality of coil patterns are stacked may be the thickness direction of the body.

The first and second external electrodes may be disposed on the first and second end surfaces, respectively.

The plurality of coil patterns may further include a fourth coil pattern, and the external electrode may further include a fourth external electrode connected to the fourth coil pattern.

The fourth coil pattern may include a plurality of sub-coil patterns.

According to another aspect of the present disclosure, a coil component may include: a body including a coil and an encapsulant encapsulating the coil; and three or more external electrodes disposed on an external surface of the body, in which a core center of the coil is filled with the encapsulant, the coil includes three or more coil patterns, stacked in one direction, electrically connected to each other through a via, and each of the three or more coil patterns has a lead portion, which is directly connected to a corresponding external electrode of the three or more external electrodes.

At least one intermediate coil pattern among the three or more coil patterns may have a stacked structure in which a plurality of sub-coil patterns are connected to each other through the via.

At least one intermediate coil pattern among the three or more coil patterns may include a portion having a line width, which is different from a line width of an uppermost coil pattern or a lowermost coil pattern among the three or more coil patterns.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, a coil component according to an exemplary embodiment in the present disclosure will be described. However, the present disclosure is not necessarily limited thereto.

Figure 1:
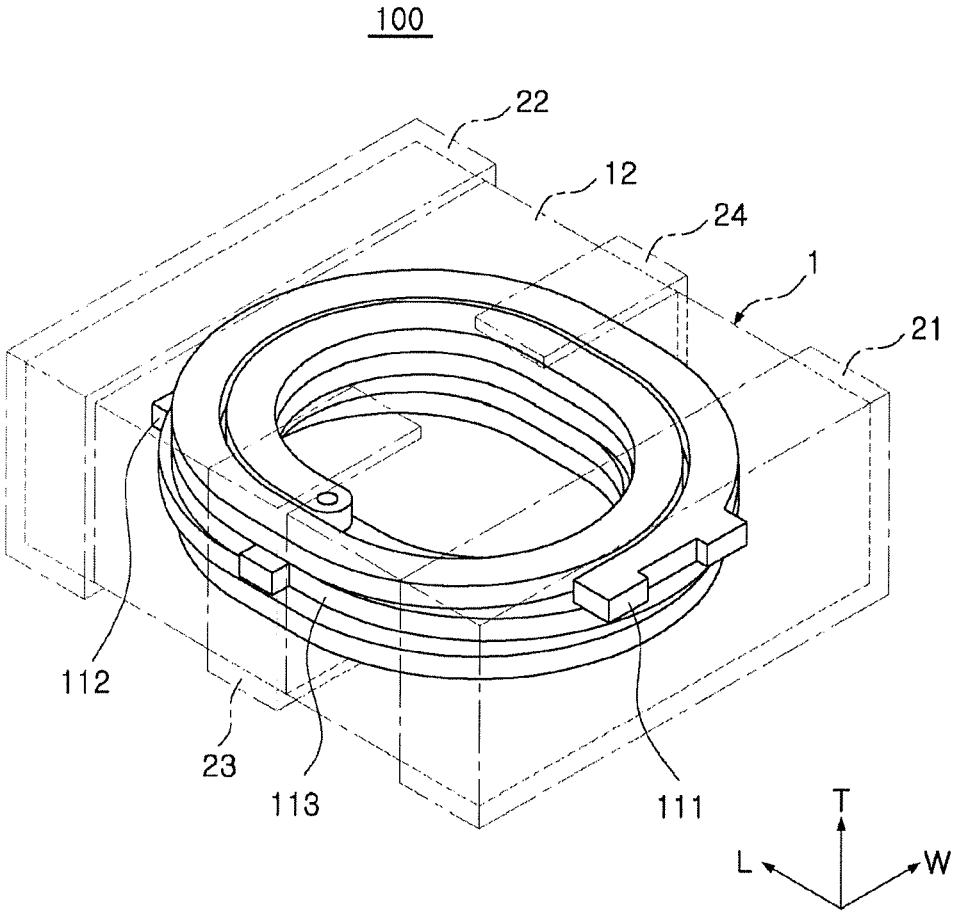
FIG. 1 is a schematic perspective view illustrating a coil component according to an exemplary embodiment in the present disclosure.
Figure 2:
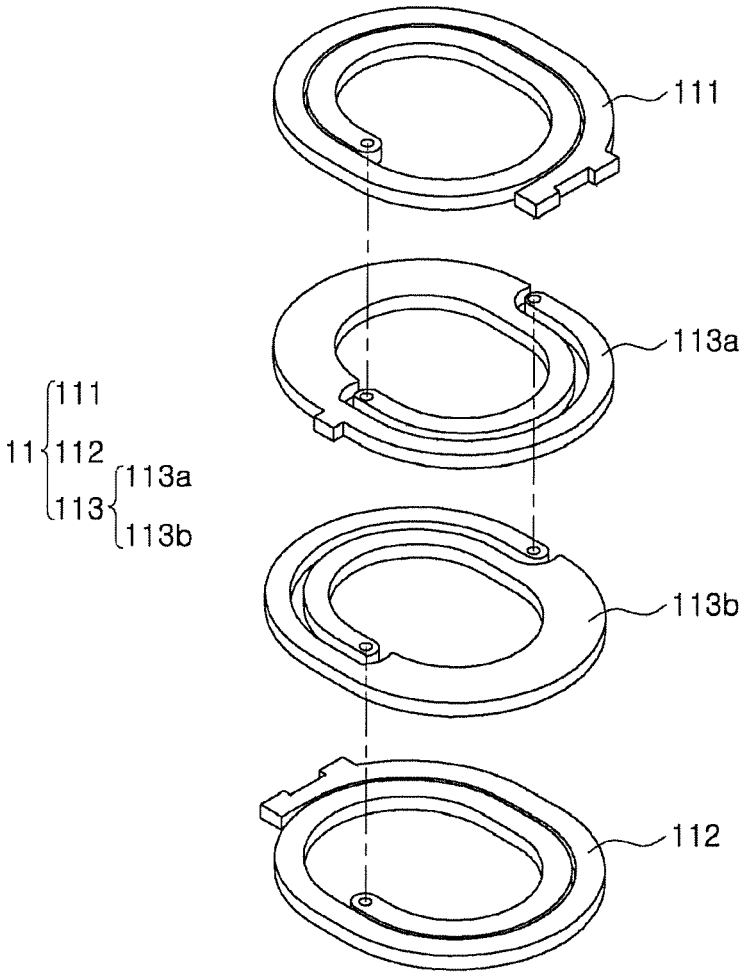
FIG. 2 is an exploded perspective view illustrating a coil of FIG. 1.
Figure 3A:
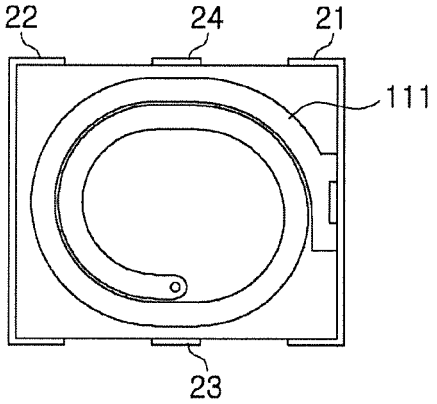
FIGS. 3A through 3D are plan views of the respective coil patterns of FIG. 1 when viewed from the top.
Figure 3B:
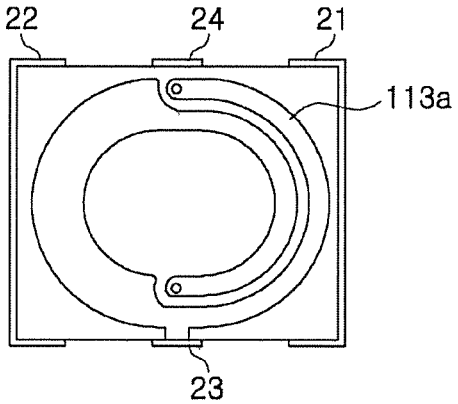
Figure 3C:
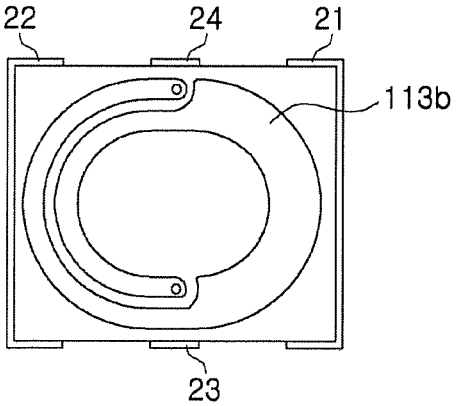
Figure 3D:
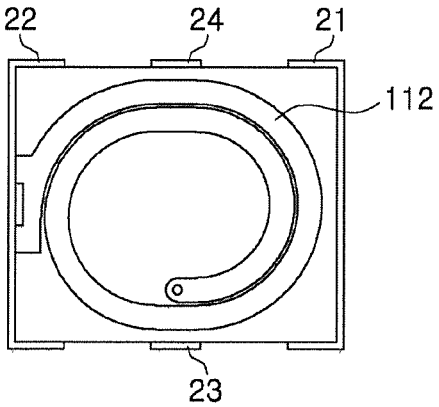

FIG. 1 is a schematic perspective view illustrating a coil component according to an exemplary embodiment in the present disclosure, FIG. 2 is an exploded perspective view illustrating a coil of FIG. 1, and FIG. 3 is a plan view of each coil pattern of FIG. 1 when viewed from the top.

Referring to FIGS. 1 through 3, a coil component 100 according to an exemplary embodiment in the present disclosure may include a body 1 and first to third external electrodes 21 to 23 disposed on external surfaces of the body.

The body 1 may form an appearance of the coil component 100, and may have upper and lower surfaces opposing each other in a thickness direction T, first and second end surfaces opposing each other in a length direction L, and first and second side surfaces opposing each other in a width direction W to substantially have a hexahedral shape.

The body 1 may include an encapsulant 12. The encapsulant 12 may be any material having a magnetic property, for example, ferrite or metal based soft magnetic materials. The ferrite may include any known ferrite such as Mn—Zn based ferrite, Ni—Zn based ferrite, Ni—Zn—Cu based ferrite, Mn—Mg based ferrite, Ba based ferrite, Li based ferrite, or the like. The metal based soft magnetic material may be an alloy including one or more selected from the group consisting of Fe, Si, Cr, Al, and Ni. For example, the metal based soft magnetic material may include Fe—Si—B—Cr based amorphous metal particles, but is not limited thereto. The metal based soft magnetic materials may have a particle diameter of 0.1 μm or more to 20 μm or less, and may be included in a polymer such as an epoxy resin, polyimide, or the like, in a form in which they are dispersed on the polymer.

The body 1 may include a coil 11. The coil 11 may have a spiral shape, and may have a structure in which a plurality of coil patterns are stacked in the thickness direction. The plurality of coil patterns may be electrically connected to each other by a via.

The plurality of coil patterns may include a first coil pattern 111 directly connected to the first external electrode 21, a second coil pattern 112 directly connected to the second external electrode 22, and a third coil pattern 113 directly connected to the third external electrode 23.

Referring to FIG. 1, a dummy electrode 24 disposed to face the third external electrode 23 connected to the third coil pattern 113 may be included in the coil component 100. The dummy electrode 24 may be an electrode that is not directly connected to a coil pattern and thus, does not function as an input terminal or an output terminal when the coil component is used. The dummy electrode 24 may be optionally used, and in some cases, the third external electrode 23 may extend from the first side surface to the second side surface without forming the dummy electrode. The dummy electrode 24 may be selectively introduced in order to balance the appearance of the coil component and stably mount the coil component. Therefore, the dummy electrode 24 may be disposed on the external surface of the body 1, but may not be directly connected to the coil pattern or other external electrodes.

Meanwhile, referring to FIGS. 2 and 3, the third coil pattern 113 may include a plurality of sub-coil patterns 113*a* and 113*b* unlike the first and second coil patterns 111 and 112 each formed as a single coil pattern. In this case, since each of the first and second coil patterns 111 and 112 is formed as the single coil pattern, one end portion of each of the first and second coil patterns 111 and 112 may be formed of a lead portion for being connected to the external electrode, and the other end portion thereof may be connected to the via for being connected to another coil pattern. On the other hand, in the third coil pattern 113 configured in a stacked structure by including a plurality of sub-coil patterns stacked in the thickness direction, it is sufficient that only one end portion of at least one sub-coil pattern is directly connected to the third external electrode 23, and other end portions of the sub-coil patterns may thus be configured to be connected to the via. Therefore, both end portions of at least one of the sub-coil patterns may be connected to the via.

Figure 4:
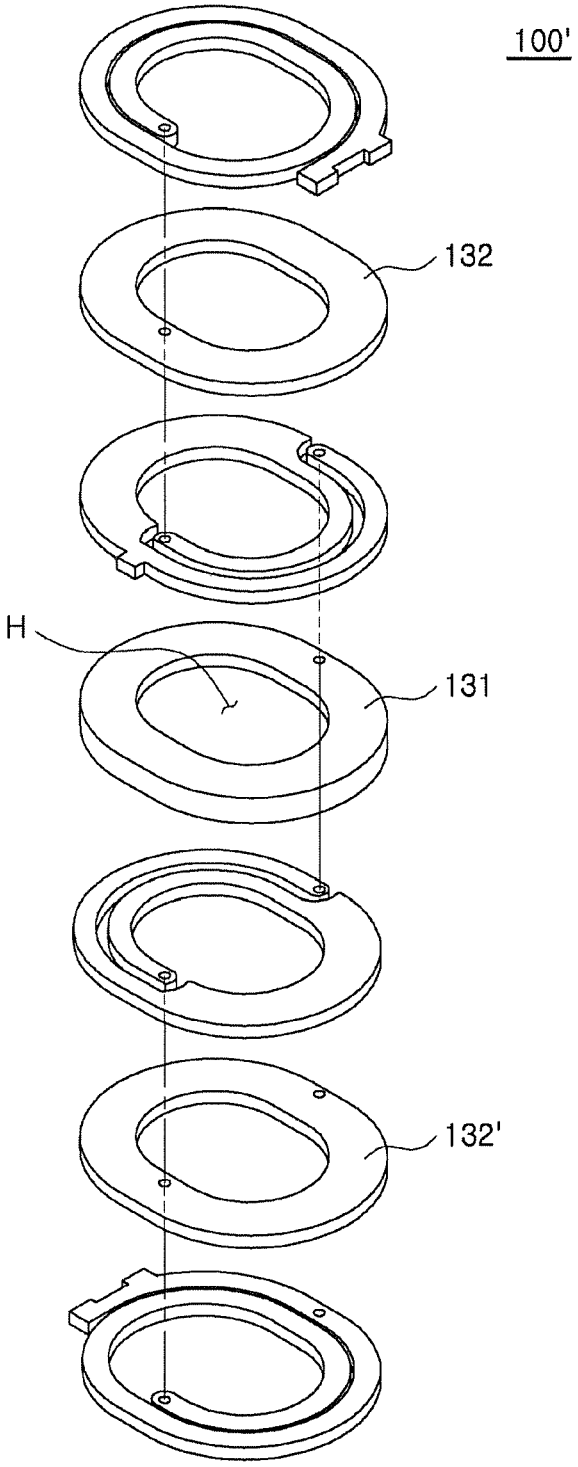
FIG. 4 is an exploded perspective view illustrating a modified example of FIG. 2.

Meanwhile, the respective coil patterns disposed at upper and lower portions may be spaced apart from each other by the encapsulant 12 filled in the body 1, as illustrated in FIGS. 1 through 3D, or may be spaced apart from each other by a support member 131 having a substrate shape or a thin film layer 132 or 132' having a thin film shape as in a coil component 100' illustrated in FIG. 4.

Referring to FIG. 4, the support member 131 may be disposed at the center of a stacked structure of the plurality of coil pattern and serve to stably support the plurality of coil patterns. The support member 131 may not only serve to support the plurality of coil patterns, but may also serve to allow a process to be more easily performed when the coil patterns are formed. Therefore, the support member 131 may have any thin plate shape with an insulation property, and may be, for example, any known copper clad laminate (CCL). The support member 131 may include a through-hole H formed at the center thereof, and an inner portion of the through-hole may be filled with the encapsulant 12. Since the inner portion of the through-hole H constitutes a core center of the coil 11, the core center may be filled with the encapsulant 12 having the magnetic property, such that a magnetic permeability of the coil component 100' may be increased. In addition, the support member 131 may include a via hole spaced apart from the through-hole H, and the via hole may be filled with a conductive material to constitute a via.

In addition to the support member 131, each of the thin film layers 132 and 132' disposed between coil patterns adjacent to each other may be an insulating film having a thickness smaller than that of the support member 131, for example, an Ajinomoto build-up film (ABF). The thin film layer may also include a via, similar to the support member 131, and may allow coil patterns disposed, respectively, on upper and lower surfaces of the thin film layer 132 or 132' to be connected to each other. The coil pattern may be easily formed by the thin film layer 132 or 132', and the thin film layer 132 or 132' may have a thickness of about 10 μm, such that miniaturization of the coil component may be implemented.

The coil component may be a three-terminal coil component, and a plurality of inductances may be implemented by only one coil component. For example, an inductance C1 of the coil component in a case in which the first and second external electrodes connected to the first and second coil patterns, respectively, are used as a lead terminal and an output terminal, respectively, is greater than an inductance C2 in a case in which the first and third external electrodes connected to the first and third coil patterns, respectively, are used as a lead terminal and an output terminal, respectively, and at least two kinds of inductances may thus be implemented.

Figure 5:
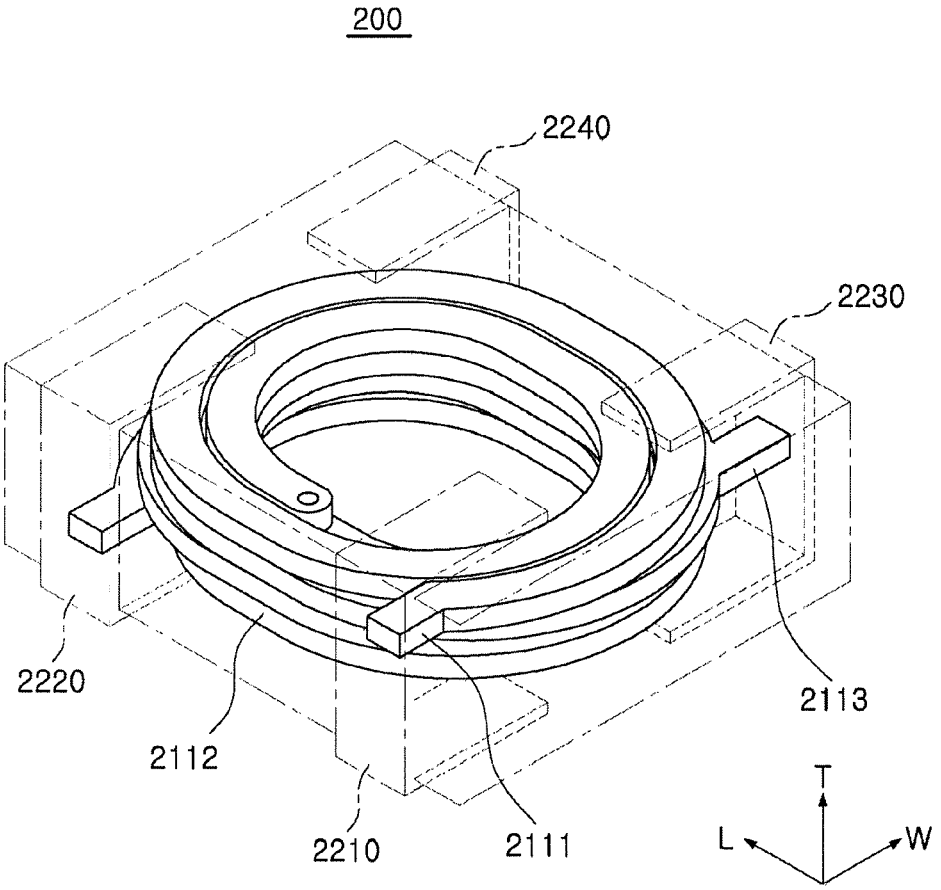
FIG. 5 is a schematic perspective view illustrating a coil component according to a modified example of FIG. 1.
Figure 6:
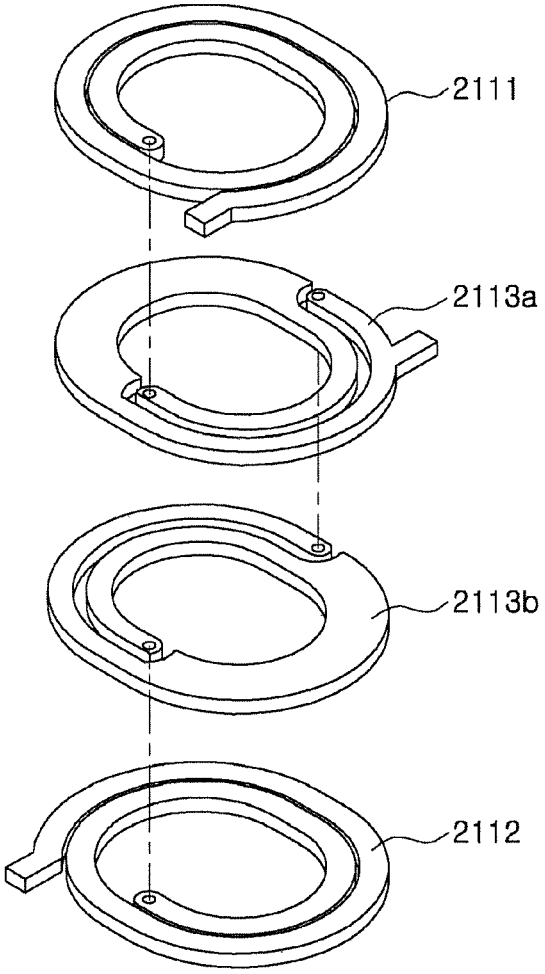
FIG. 6 is an exploded perspective view illustrating a coil of FIG. 5.
Figure 7A:
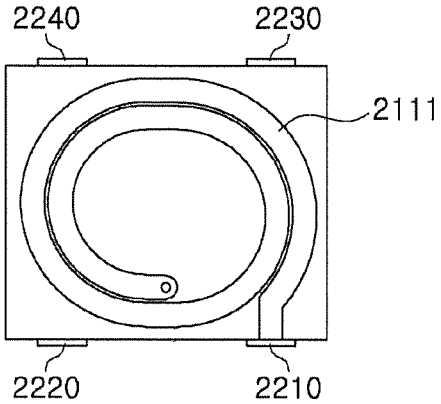
FIGS. 7A through 7D are plan views of the respective coil patterns of FIG. 5 when viewed from the top.
Figure 7B:
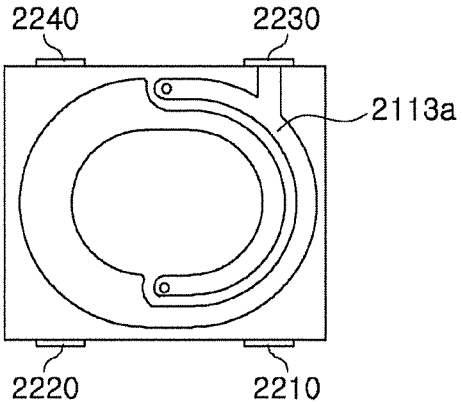
Figure 7C:
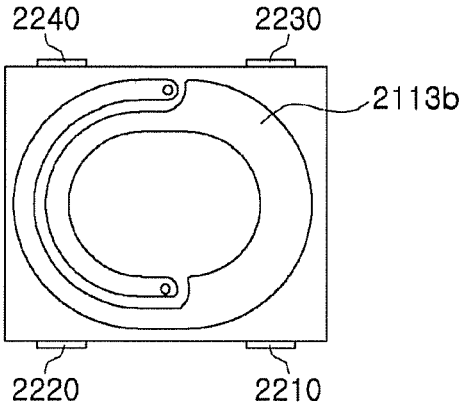
Figure 7D:
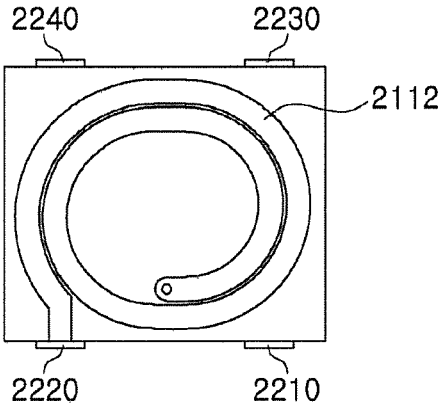

FIG. 5 is a schematic perspective view illustrating a coil component 200 according to a modified example of FIG. 1. FIG. 6 is an exploded perspective view illustrating a coil of FIG. 5. FIGS. 7A through 7D are plan views of the respective coil patterns of FIG. 5 when viewed from the top.

The coil component 200 illustrated in FIGS. 5 through 7D may be different in positions of lead portions and positions of external electrodes connected to the lead portions from the coil component 100 illustrated in FIGS. 1 through 3D. For convenience of explanation, an overlapping description between the coil components 100 and 200 will be omitted.

In the coil component 200, a lead portion of a first coil pattern 2111 and a lead portion of a second coil pattern 2112 may be led to the same external surface of the body. Referring to FIG. 5, the lead portion of a first coil pattern 2111 and the lead portion of a second coil pattern 2112 may be led to the first side surface of the external surfaces of the body, but are not limited thereto.

First and second external electrodes 2210 and 2220 connected to the first and second coil patterns 2111 and 2112, respectively, may be disposed to be spaced apart from each other on the first side surface, and may extend to one or more of the upper surface and the lower surface of the body.

A third coil pattern 2113 including a plurality of sub-coil patterns 2113*a* and 2113*b* may be interposed between the first and second coil patterns 2111 and 2112.

A third external electrode 2230 directly connected to the third coil pattern 2113 may be disposed on the second side surface opposing the first side surface, and may be connected to a lead portion led to the second side surface.

The coil component 200 may further include a dummy electrode 2240, which is disposed on the second side surface on which the third external electrode 2230 is disposed. The dummy electrode 2240 may have the same shape as that of each of the first to third external electrode 2210 to 2230, and may be formed in a symmetrical structure together with the first to third external electrode 2210 to 2230 to maintain a balance of the coil component 200 when the coil component 200 is mounted and enhance an adhesive property. Referring to FIGS. 7A through 7D, it may be seen that the dummy electrode 2240 is not directly connected to any of the coil patterns 2111 to 2113.

Figure 8:
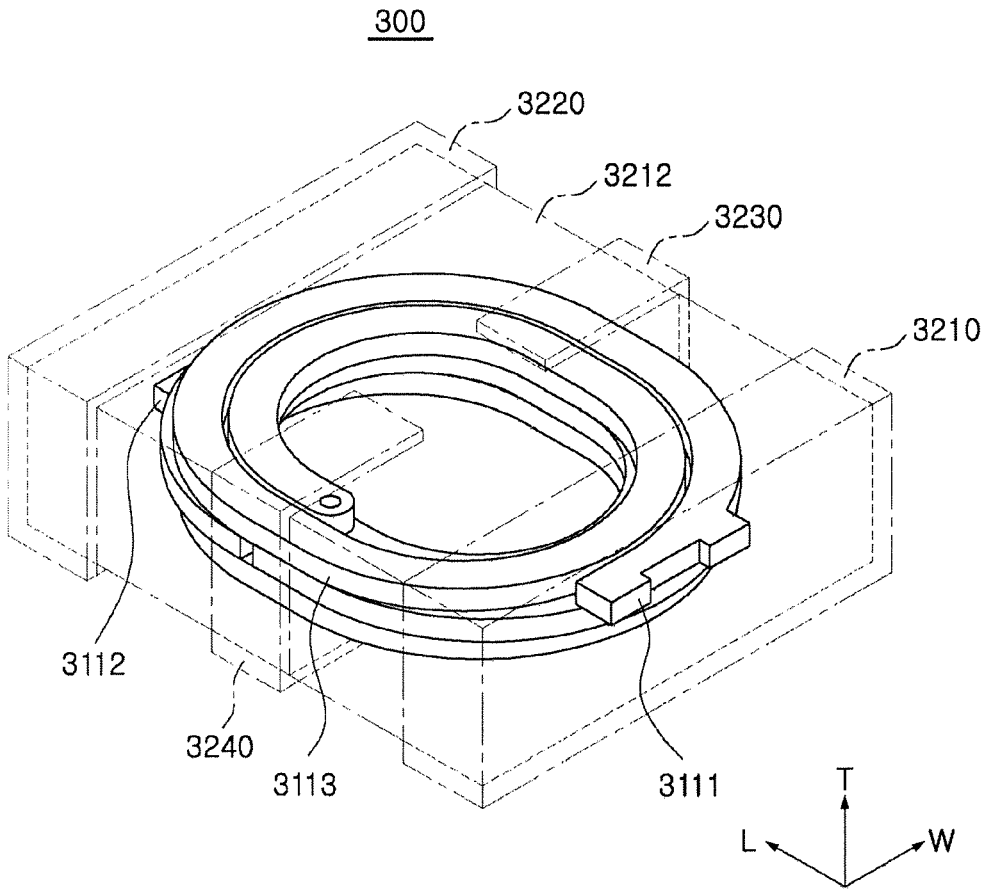
FIG. 8 is a schematic perspective view illustrating a coil component according to another modified example of FIG. 1.
Figure 9:
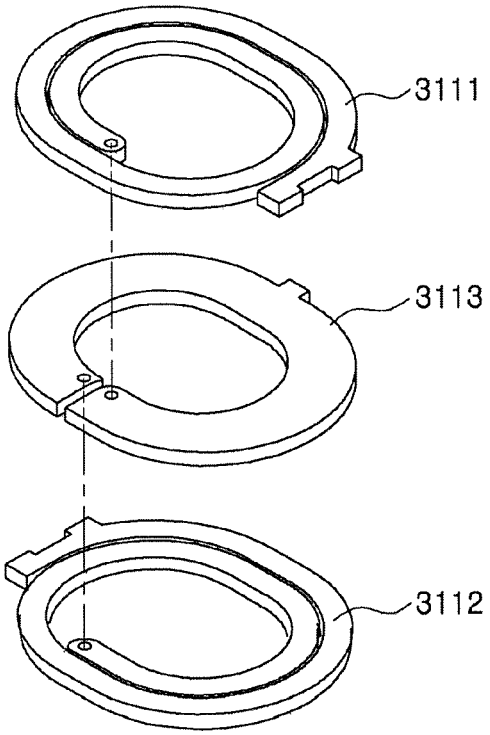
FIG. 9 is an exploded perspective view illustrating a coil of FIG. 8.
Figure 10A:
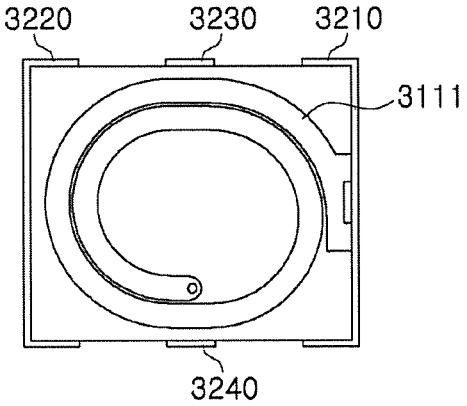
FIGS. 10A through 10C are plan views of the respective coil patterns of FIG. 8 when viewed from the top.
Figure 10B:
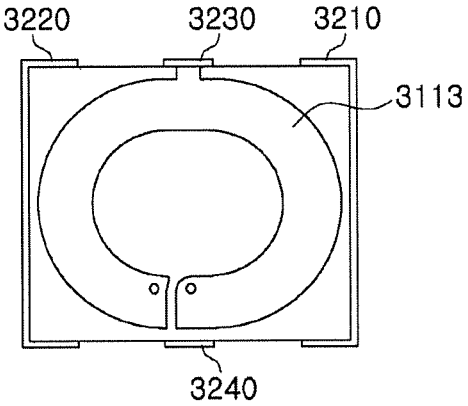
Figure 10C:
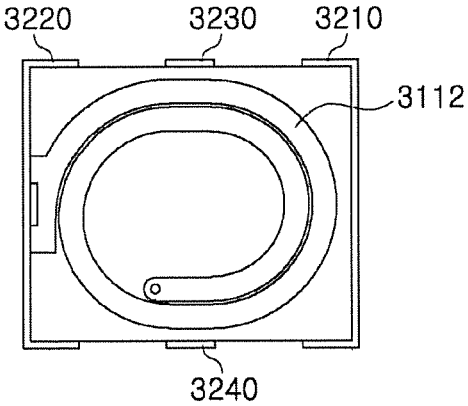

Next, FIG. 8 is a schematic perspective view illustrating a coil component 300 according to another modified example of FIG. 1, FIG. 9 is an exploded perspective view illustrating a coil of FIG. 8, and FIGS. 10A through 10C are plan views of the respective coil patterns of FIG. 8 when viewed from the top.

Referring to FIGS. 8 through 10C, the coil component 300 may include only three coil patterns 3111, 3112, and 3113. The coil component 300 may be different from the first coil component 100 of FIG. 1 in that a third coil pattern 3113 is configured as a single coil pattern, similar to first and second coil patterns 3111 and 3112, and may include components that are substantially the same as those of the coil component 100.

Since the third coil pattern 3113 is directly connected to a third external electrode 3230 and is configured as the single coil pattern, the third coil pattern 3113 may not include separate sub-coil patterns.

The coil component 300 including only the three coil patterns may implement a plurality of inductances including an inductance formed by the first and third coil pattern and an inductance formed by the first to third coil patterns.

Figure 11:
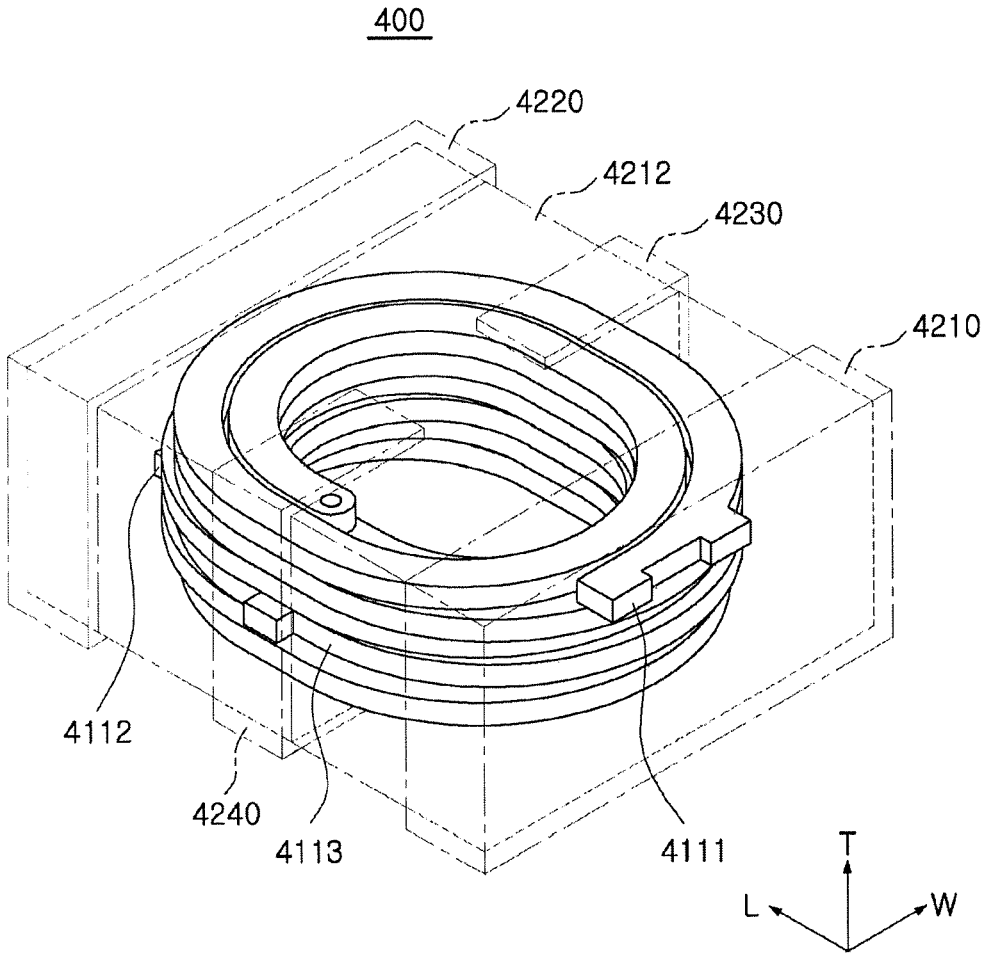
FIG. 11 is a schematic perspective view illustrating a coil component according to another modified example of FIG. 1.
Figure 12:
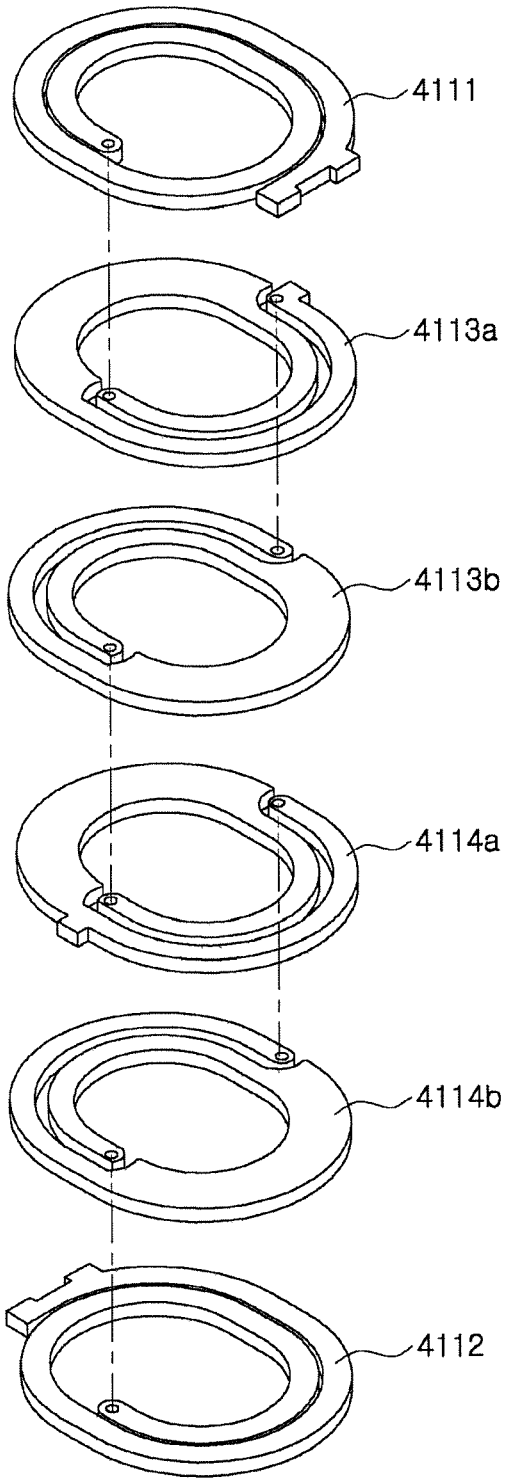
FIG. 12 is an exploded perspective view illustrating a coil of FIG. 11.
Figure 13A:
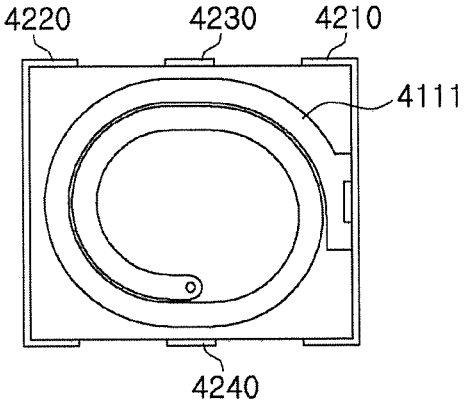
FIGS. 13A through 13F are plan views of the respective coil patterns of FIG. 11 when viewed from the top.
Figure 13B:
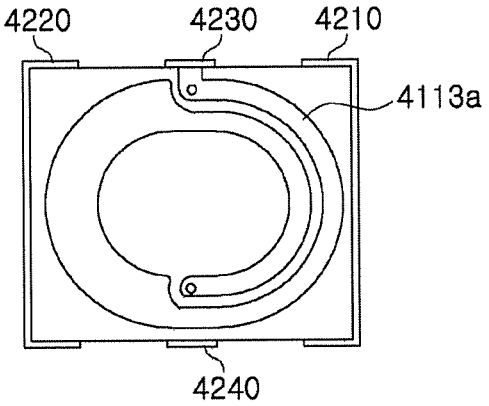
Figure 13C:
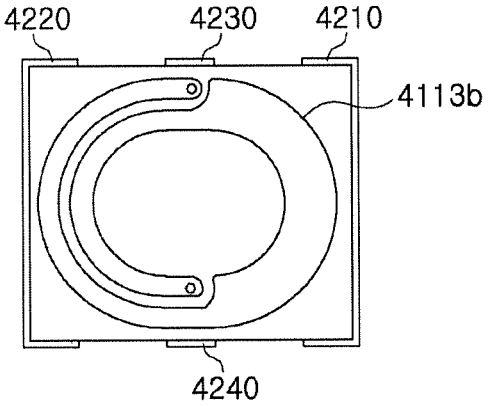
Figure 13D:
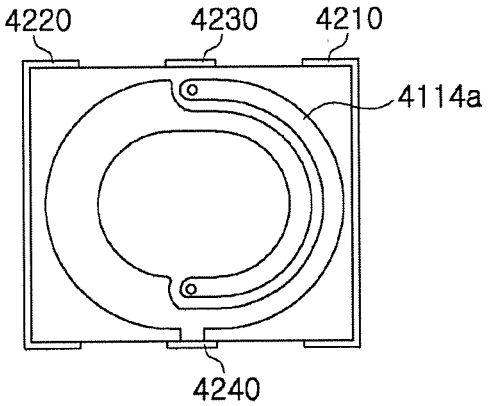
Figure 13E:
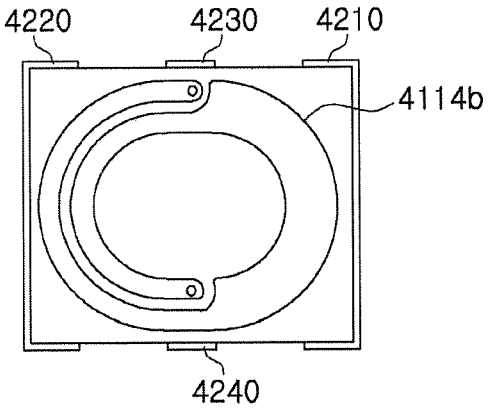
Figure 13F:
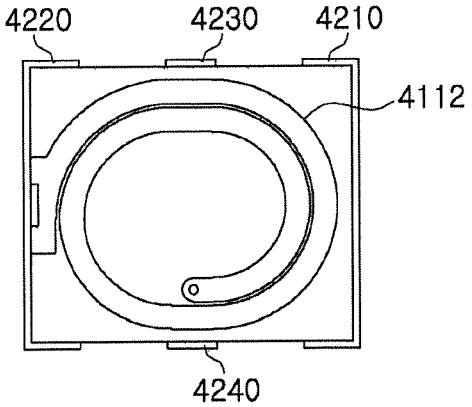

Next, FIG. 11 is a schematic perspective view illustrating a coil component 400 according to another modified example of FIG. 1, FIG. 12 is an exploded perspective view illustrating a coil of FIG. 11, and FIGS. 13A through 13F are plan views of the respective coil patterns of FIG. 11 when viewed from the top.

Referring to FIGS. 11 through 13F, the coil component 400 may include a first coil pattern 4111, a second coil pattern 4112, a third coil pattern 4113, and a fourth coil pattern 4114.

The third and fourth coil patterns may have a structure in which they are stacked on the first and second coil patterns, respectively. The third coil pattern 4113 may include a stacked structure including first and second sub-coil patterns 4113*a* and 4113*b*, and the fourth coil pattern 4114 may include a stacked structure including first and second sub-coil patterns 4114*a* and 4114*b*.

The first to fourth coil patterns 4111 to 4114 may be directly connected to first to fourth external electrodes 4210, 4220, 4230, and 4240, respectively. In this case, since the fourth external electrode 4240 is directly connected to the fourth coil pattern 4114, the fourth external electrode 4240 may not be a dummy electrode and may be an external terminal contributing to formation of an inductance. For example, when the second external electrode 4220 and the fourth external electrode 4240 are configured as an input terminal and an output terminal, respectively, an inductance formed by the second coil pattern 4112 and the first and second sub-coil patterns 4114*a* and 4114*b* of the fourth coil pattern may be implemented.

The external electrodes may be appropriately disposed in consideration of positions to which the lead portions of the coil patterns are led, and as illustrated in FIG. 11, the first and second external electrodes 4210 and 4220 may be disposed on the first and second end surfaces, respectively, and the third and fourth external electrodes 4230 and 4240 may be disposed to oppose each other in the width direction between the first and second external electrodes 4210 and 4220, such that the first to fourth external electrodes 4210 to 4240 may be configured to be symmetrical to each other.

As set forth above, according to the exemplary embodiment in the present disclosure, a coil component in which a plurality of inductances may be simultaneously implemented in one chip without having a difficulty in a process may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a coil and an encapsulant encapsulating the coil; and an external electrode disposed on an external surface of the body, wherein a core center of the coil is filled with the encapsulant, the coil includes a plurality of coil patterns electrically connected to each other through a via, the plurality of coil patterns have a stacked structure in which the plurality of coil patterns are stacked in one direction, the external electrode includes a first external electrode, a second external electrode, and a third external electrode disposed to be spaced apart from one another, wherein the first and second external electrodes are disposed to oppose each other in a length direction of the body, the plurality of coil patterns include a first coil pattern having a portion directly connected to the first external electrode, a second coil pattern having a portion directly connected to the second external electrode, and a third coil pattern having a portion directly connected to the third external electrode, the third coil pattern is disposed between the first and second coil patterns in the one direction, the third coil pattern includes a first portion in a shape of a single winding turn and a second portion in a shape of multiple winding turns that overlap each other, and the first coil pattern or the second coil pattern is in the shape of the single winding turn, and is located in an outermost layer in the stacked structure in the one direction.

2. The coil component of claim 1, wherein at least one of the first to third coil patterns has a stacked structure in which a plurality of coil patterns are connected to each other through the via.

3. The coil component of claim 2, wherein the at least one of the first to third coil patterns having the stacked structure includes a plurality of sub-coil patterns, and both end portions of at least one of plurality of the sub-coil patterns are connected to the via.

4. The coil component of claim 1, wherein the body further includes a support member in contact with the plurality of coil patterns.

5. The coil component of claim 4, wherein the support member includes a through-hole, and the through-hole coincides with the core center of the coil.

6. The coil component of claim 1, wherein the external electrode further includes a dummy electrode that is not directly connected to any of the plurality of coil patterns.

7. The coil component of claim 6, wherein the dummy electrode is disposed to be symmetrical to one of the first to third external electrodes.

8. The coil component of claim 1, wherein a thin film layer including a via is disposed between coil patterns adjacent to each other.

9. The coil component of claim 8, wherein the thin film layer is an insulating film.

10. The coil component of claim 8, wherein a thickness of the thin film layer is smaller than that of the support member.

11. The coil component of claim 1, wherein at least one coil pattern among the plurality of coil patterns includes at least one line width change portion in which a line width of the at least one coil pattern changes in a winding direction.

12. The coil component of claim 1, wherein the body has first and second end surfaces opposing each other in the length direction of the body, first and second side surfaces opposing each other in a width direction of the body, and upper and lower surfaces opposing each other in a thickness direction of the body.

13. The coil component of claim 12, wherein the one direction in which the plurality of coil patterns are stacked is the thickness direction of the body.

14. The coil component of claim 12, wherein the first and second external electrodes are disposed on the first and second end surfaces, respectively, and wherein the third external electrode is disposed between the first and second external electrodes.

15. The coil component of claim 1, wherein the plurality of coil patterns further include a fourth coil pattern, and the external electrode further includes a fourth external electrode connected to the fourth coil pattern, and wherein the fourth coil pattern includes a plurality of sub-coil patterns.

16. A coil component comprising:

a body including a coil and an encapsulant encapsulating the coil; and an external electrode disposed on an external surface of the body, wherein a core center of the coil is filled with the encapsulant, the coil includes a plurality of coil patterns electrically connected to each other through a via, the plurality of coil patterns have a stacked structure in which the plurality of coil patterns are stacked in one direction, the external electrode includes a first external electrode, a second external electrode, and a third external electrode disposed to be spaced apart from one another, the plurality of coil patterns include a first coil pattern having a portion directly connected to the first external electrode, a second coil pattern having a portion directly connected to the second external electrode, and a third coil pattern having a portion directly connected to the third external electrode, the third coil pattern includes a first portion and a second portion opposing each other in a length direction of the body in which the first and second external electrodes oppose each other, wherein the first portion is in a shape of a single winding turn and the second portion is in a shape of multiple winding turns that overlap each other, and the first coil pattern or the second coil pattern is in the shape of the single winding turn, and is located in an outermost layer in the stacked structure in the one direction.

17. The coil component of claim 16, wherein a line width of the single winding turn of the first portion is larger than a line width of each of the multiple winding turns of the second portion.

* * * * *